United States Patent [19]

Dill

[11] Patent Number: 4,734,573

[45] Date of Patent: Mar. 29, 1988

[54] IMAGE INTENSIFIER WITH ADDITIONAL POWER SUPPLY

[75] Inventor: James M. Dill, Pompano Beach, Fla.

[73] Assignee: EOL3 Company, Inc., Ft. Lauderdale, Fla.

[21] Appl. No.: 885,036

[22] Filed: Jul. 14, 1986

[51] Int. Cl.[4] ..... H01J 31/50

[52] U.S. Cl. ..... 250/213 VT

[58] Field of Search ..... 250/213 VT, 532, 533, 250/534, 535, 536, 361 R; 363/21, 97

[56] References Cited

U.S. PATENT DOCUMENTS

| | | | |
|---|---|---|---|
| 3,612,762 | 3/1969 | Wuellner et al. . | |
| 3,903,417 | 9/1975 | Peter | 250/361 |
| 3,974,331 | 8/1976 | Pepin . | |
| 4,025,955 | 9/1975 | Grallien et al. | 358/219 |
| 4,412,128 | 1/1981 | McDonald | 250/213 VT |

*Primary Examiner*—David C. Nelms
*Assistant Examiner*—Chung Seo
*Attorney, Agent, or Firm*—Oltman and Flynn

[57] ABSTRACT

An image intensifier with an internal power supply that produces 20,000–25,000 Hz. noise in the output screen voltage is provided with an additional power supply coupled to the output screen through an R-C filter which removes that noise. The additional power supply produces the screen voltage at a current that is a large multiple of the current produced by the output screen voltage of the internal power supply, so that the screen voltage from the additional power supply prevails over the screen voltage from the internal power supply. The additional power supply is regulated by an optical coupler which responds to the light input level to the image intensifier, as follows: at light inputs above about $5\times10^{-5}$ footcandle, the screen voltage from the additional power supply is less than the usual screen voltage from the internal power supply; at light levels higher than that the screen voltage from the additional power supply increases with decreasing light input and it is higher than the usual screen voltage from the internal power supply throughout the light input range below about $10^{-5}$ footcandle.

14 Claims, 2 Drawing Figures

IMAGE INTENSIFIER WITH ADDITIONAL POWER SUPPLY

SUMMARY OF THE INVENTION

This invention relates to a power supply arrangement for the output screen of an image intensifier.

"Second generation" image intensifiers, which have a microchannel plate between the focusing electrode and the phosphor output screen, typically have a complex built-in power supply which develops different high positive and negative voltages for the different elements of the image intensifier from a three volt source consisting of two size AA dry cell batteries. In the process of stepping up the voltage from the three volt source, the power supply produces enough noise in the high positive voltage (e.g., +6000 volts) which it applies to the output screen that this noise tends to mask the output screen signal current produced by the light impinging on that screen. In such image intensifiers the phosphor output screen is covered by a fiber optic screen plate, as in the photocathode. When the output screen is read by the human eye, this noise problem does not destroy the practical utility of the image intensifier. However, when the output screen is coupled directly to an electronic scanner or sensor, the power supply noise is so serious a problem as to make the apparatus virtually useless as a means of conversion to an electronic scanned image. Such an electronic scanner may be a vidicon with a fiber optic faceplate intimately coupled to the fiber optic screen plate on the output screen of the image intensifier, or it may be a silicon-intensified-target (SIT) vidicon or an intensified-silicon-intensified-target (ISIT) vidicon.

A principal object of this invention is to provide a novel power supply arrangement for overcoming this problem.

In accordance with the present invention, an additional power supply is operatively connected to the output screen through a low A.C. impedance which filters out power supply noise in the 20–25 kHz. frequency range. This additional power supply provides current to the output screen which is many times the current provided by the usual internal power supply of the image intensifier.

In accordance with another aspect of this invention, at relatively high levels of the input light to the photocathode of the image intensifier, the additional power supply holds the output screen voltage at a substantially constant level such that the screen does not provide too much amplified light input to the electronic scanner. Preferably, this screen voltage level is about +5000 volts instead of the usual +6000 volts ordinarily provided by the image intensifier's internal power supply.

Also, in accordance with another aspect of the invention, at lower levels of the light input to the image intensifier the additional power supply increases the output screen voltage as an inverse function of the light input so as to keep the overall gain of the image intensifier at a high level and keep the output screen's light level high enough that it can be read by the electronic scanner, thus extending the dynamic range of the image intensifier.

Further objects and advantages of this invention will be apparent from the following detailed description of a presently preferred embodiment with reference to the accompanying drawing.

Before explaining the disclosed embodiment of the present invention in detail it is to be understood that the invention is not limited in its application to the details of the particular arrangement shown since the invention is capable of other embodiments. Also, the terminology used herein is for the purpose of description and not of limitation.

DETAILED DESCRIPTION

Figure 1:
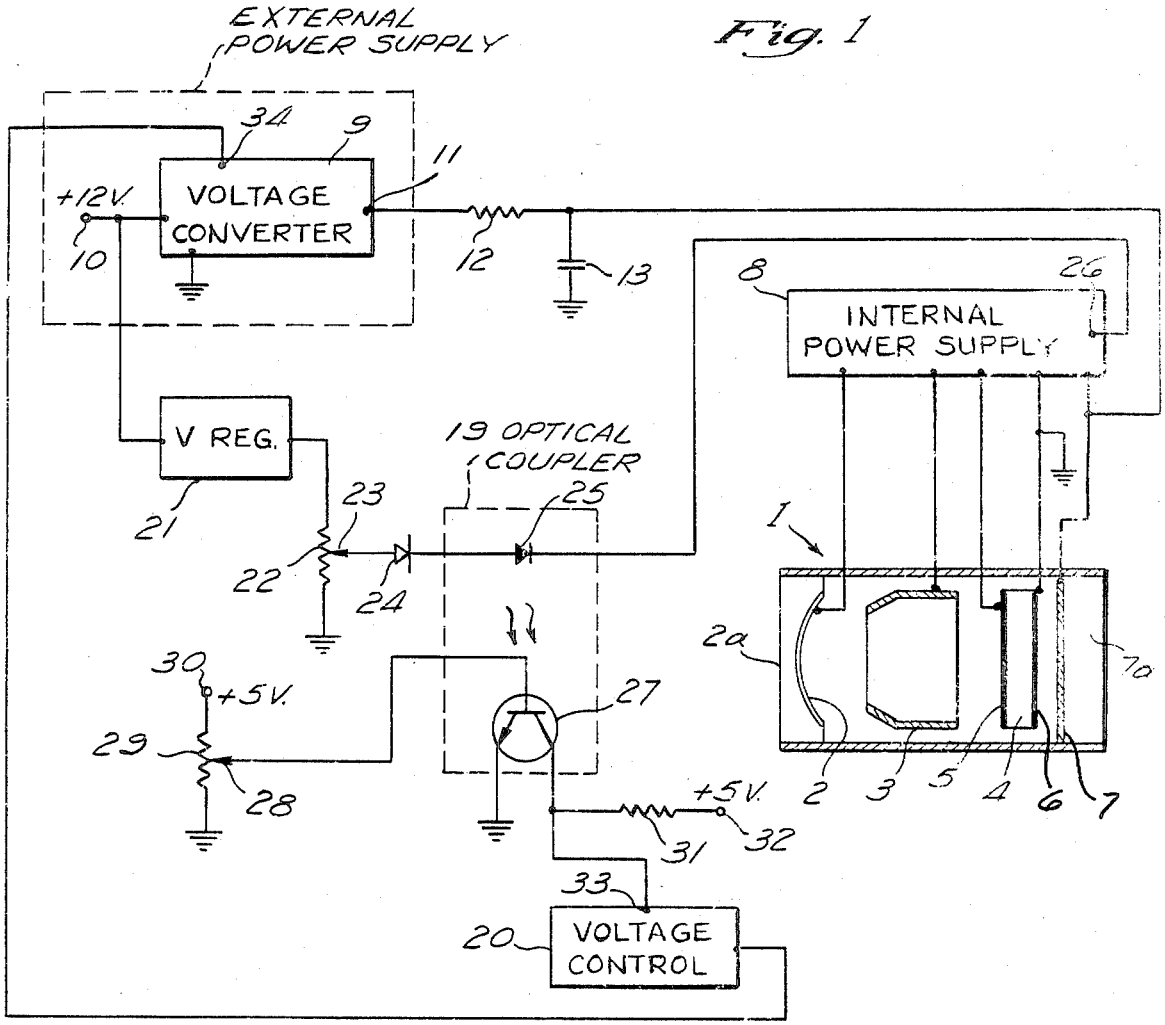
FIG. 1 is a schematic circuit diagram of a presently preferred embodiment of this invention.

Referring to FIG. 1, reference numeral 1 designates generally an image intensifier tube of known design which is shown in simplified schematic form here. It has a photocathode 2 at one end with a fiberoptic faceplate 2*a* which is exposed to incident light, an anode and focusing cone 3, a microchannel plate 4 having an input electrode 5 on its face toward the photocathode and an output electrode 6 on its face away from the photocathode, and a phosphorescent output screen 7 with a fiberoptic faceplate 7*a* at the opposite end. This is a typical "second generation" image intensifier. The optical image formed on the photocathode 2 by the incident light is converted by it into an electron image, which is multiplied by the microchannel plate 4 and applied to the output screen 7, which produces an optical image which is an intensified replica of the optical image on the photocathode.

In one practical embodiment, the photocathode 2 is at −1750 volts, the anode and focusing cone 3 is at +1000 volts, the input electrode 5 of the microchannel plate 4 is at +900 volts and its output electrode 6 is at reference ground, and the output screen 7 is at +6000 volts when it is to be viewed by a human person. In portable image intensifiers these voltages are supplied by an internal power supply, shown schematically at 8, having a 3 volt DC power source in the form of two size AA dry cell batteries. This battery voltage is stepped up in the internal power supply 8 to provide the different voltages for various electrodes of the image intensifier. The final field voltage (+6000 v) on the output screen 7 is provided by a 12-to-1 voltage multiplier in the internal power supply 8 and is of such low current (on the order of a few microamperes) that it cannot be loaded with sufficient filter elements to provide a ripple-free voltage.

I have determined that this noise in the output screen voltage falls primarily within the frequency range from 20,000 to 25,000 Hz.

In accordance with the present invention, this noise can be removed by providing an additional power supply, preferably external to the image intensifier, which presents a very low impedance in this noise frequency range and provides current which is a large multiple of the screen current provided by the internal power supply 8. In FIG. 1 this additional power supply is shown schematically as including a voltage converter 9 having an input terminal 10 connected to the positive terminal of a 12 volt battery. The voltage converter raises this battery voltage to a variable voltage of several thousand volts, depending upon a voltage control circuit or device 20. The output terminal 11 of this voltage converter is connected through a resistor 12 to the output screen 7 to apply the desired voltage to the latter at a few hundred microamperes. Because of its much greater current, the voltage from the additional power supply 9, 10 to the output screen 7 of the image intensifier prevails over the screen voltage (whether higher or lower) provided by the internal power supply 8. That is, the external power supply 9,10 establishes the voltage on the output screen 7 irrespective of the voltage from the internal power supply 8 on that screen. A capacitor 13 is connected between the screen-connected terminal of resistor 12 and ground.

It will be evident that resistor 12 and capacitor 13 constitute a low pass filter between the voltage converter 9 and the load (output screen 7). The capacitor 13 is required to filter out (by bypassing to ground) noise signals on the output screen 7 with the frequency range from about 20,000–25,000 Hz. It is required that the capacitor 13 have a very low reactive impedance in this frequency range.

As an example, if the maximum impedance of capacitor 13 in the 20–25 kHz noise range is chosen to be 1 ohm, then capacitor 13 may have a capacitance of about 8 microfarads. For an AC output impedance of 1 ohm, the R-C circuit consisting of resistor 12 and capacitor 13 must provide at least 75 dB of attenuation at the desired frequency.

Assuming that there can be as much as a 10 volt drop across resistor 12 at 300 microamperes, then resistor 12 may have a resistance of as much as 33,333 ohms. The R-C time constant provided by the 33,333 ohm resistor and the 8 microfarad capacitor is about 0.265 second, or approximately 90 dB of attenuation. Therefore, an R-C circuit 12, 13 in the external power supply having these values of resistance and capacitance would more than satisfy the assumed requirements of not more than 1 ohm A.C. impedance in the 20–25 kHz. frequency range and not more than a 10 volt drop across resistor 12.

With this low impedance arrangement, the previously troublesome 20,000–25,000 Hz. noise generated by the internal power supply of the image intensifier is effectively bypassed to reference ground and the signal current on the output screen has a sufficiently high signal-to-noise ratio that when read by an intimately coupled electronic scanner (such as one of those mentioned in the "Summary of the Invention") it produces an electrical signal that faithfully represents the light image on the output screen.

Thus, by the provision of this additional power supply 9, 10, resistor 12 and capacitor 13, substantially noise-free power is supplied to the output screen 7 of the image intensifier, and an electronic scanner may be coupled directly to the output screen to produce an electrical signal which adequately reproduces the light image on the screen. Another advantage is better focusing of the electron image on the output screen 7 because the field voltage at the screen is substantially ripple free, thereby extending the dynamic range of the image intensifier.

The circuit of FIG. 1 also has an optical coupler 19 and a voltage control circuit or device 20 for determining the voltage that the external power supply 9, 10 applies to the output screen 7 of the image intensifier.

The +12 volt power supply terminal 10 for voltage converter 9 is connected through a voltage regulator 21 of known design to a potentiometer 22. An adjustable tap 23 on this potentiometer is connected through a rectifier diode 24 and a light emitting diode 25 to a terminal 26 of the image intensifier's internal power supply 8 which is at a voltage that is directly proportional to the total current from the internal power supply 8 to all of the electrodes of the image intensifier. LED 25 is part of the optical coupler 19.

A grounded-emitter phototransistor 27 is the second part of the optical coupler 19. The base electrode of this phototransistor is exposed to light emitted by LED 25. The base of phototransistor 27 is connected to an adjustable potentiometer tap 28 on a resistor 29 whose upper end is connected to a +5 volt power supply terminal 30 and whose lower end is grounded. The collector of phototransistor 27 is connected through a resistor 31 to a +5 volt power supply terminal 32. The collector also is connected to a control input terminal 33 of the voltage control device 20, which has its output connected to a control input terminal 34 of voltage converter 9.

LED 25 has a substantially constant voltage drop over a wide range of currents. As explained hereinafter, the light emitted by LED 25 varies inversely with the input light to the image intensifier at a low level range of that input light. Phototransistor 27 acts as an amplifier of the current in LED 25. The collector current of the phototransistor operates the voltage control device 20 such that it increases the output voltage from the voltage converter 9 in the external power supply as the light input to the image intensifier decreases, and visa versa.

Figure 2:
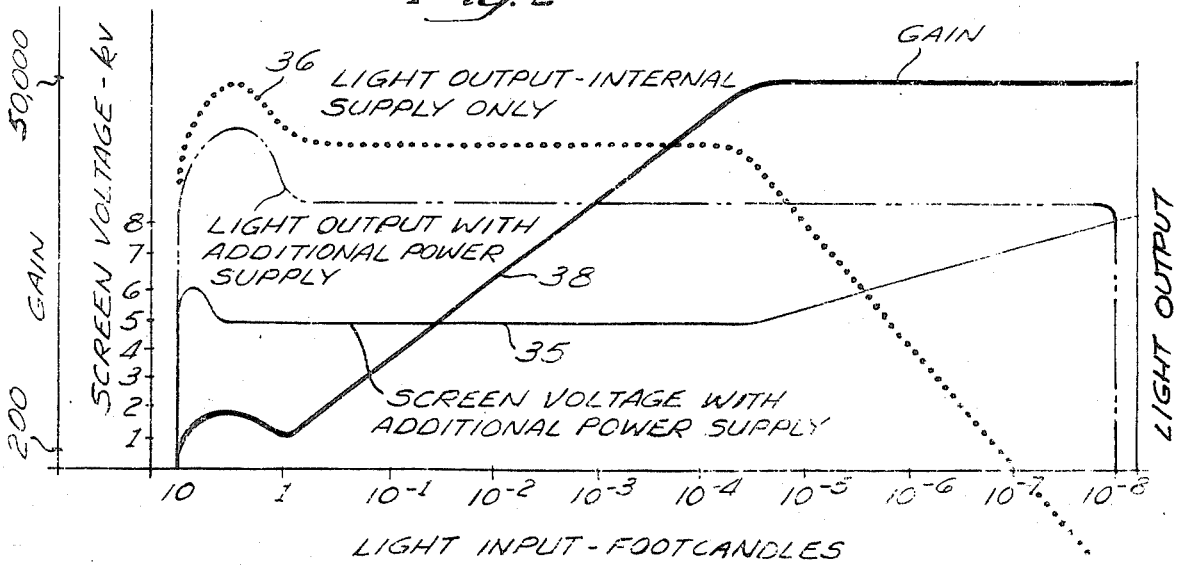
FIG. 2 shows several performance characteristics of the image intensifier plotted against the light input to its photocathode.

Referring to FIG. 2, in practice the image intensifier is not operated at light inputs greater than about 1 or 2 footcandles. The standard internal power supply 8 (FIG. 1) of the image intensifier has a protective circuit which shuts it off when the light input to its photocathode 2 exceeds this value. This is true whether the image intensifier is to be read by the human eye or by an electronic scanner.

If only the internal power supply 8 were present, it would hold the voltage on the output screen substantially constant at 6 kV through the light input range from 1 or 2 footcandles down about $10^{-8}$ footcandle. However, due to the presence of the external power supply the screen voltage is as shown by the thin full line 35 in FIG. 2. In the light input range from about 1 or 2 footcandles down to about $5\times10^{-5}$ footcandle, it holds the screen voltage substantially constant at about 5 kV. At lesser light inputs from about $5\times10^{-5}$ footcandle down to $10^{-8}$ footcandle, the external power supply increases the screen voltage as an inverse logarithmic function of the light input, as shown by this part of line 35 in FIG. 2. The screen current from the additional power supply is so much greater than the screen current from the image intensifier's internal power supply 8 that the screen voltage is effectively determined by the external power supply.

The output screen voltage produced by the external power supply is greater than the 6 kV screen voltage produced by the internal power supply 8 at all values of light input to the image intensifier less than about $10^{-5}$ footcandles.

Referring to FIG. 1, the total current from the internal power supply 8 to all of the electrodes of the image intensifier 1 produces a proportional reference voltage at terminal 26 of the internal power supply. This total image intensifier current is a direct logarithmic function of the light input to the image intensifier within the light input range from about one footcandle down to about $10^{-8}$ footcandle. That is, as the light input increases this total current increases.

As long as the light input to the image intensifier is more than about $5\times10^{-5}$ footcandle the voltage at terminal 26 will be high enough in relation to the output voltage of the voltage regulator 21 that there will be no current in LED 25, transistor 27 will be off, and voltage control 20 will maintain the output voltage of the voltage converter 9 at a level effective to maintain +5000 volts on the image intensifier's output screen 7.

If the light input to the image intensifier is less than about $5\times10^{-5}$ footcandle, the total current to the image intensifier electrodes from the internal power supply 8 will be small enough that the corresponding reference voltage at terminal 26 will be low enough to cause current to flow from the voltage regulator 21 and the potentiometer 22, 23, rectifier diode 24 and LED 25, to reference voltage terminal 26. The voltage drop across LED 25 is substantially constant over a relatively wide current range. The current through LED 25 will vary as an inverse function of the light input to the image intensifier, i.e., the lower this input light the greater the LED current.

The phototransistor 27 amplifies the response of LED 25 to the light input to the image intensifier, and this amplified response is applied to the control terminal 33 of the voltage control device 20, which in turn operates the voltage converter 9 to increase the voltage on the output screen 7 of the image intensifier with decreasing light input and to decrease the screen voltage with increasing light input, as shown by the slope of the screen voltage curve 35 in FIG. 2 in the light input range between about $5\times10^{-5}$ and $10^{-8}$ footcandle.

The position of the adjustable potentiometer tap 23 along resistor 22 determines the maximum light input to the image intensifier at which LED 25 will be on, preferably about $5\times10^{-5}$ footcandle, as already stated. The voltage control 20 limits the maximum voltage provided on the output screen 7 from the external power supply to about +8,500 volts. This occurs when the input light to the image intensifier is at or below about $10^{-8}$ footcandle.

With only the usual three volt internal power supply 8 present, the image intensifier's light output (on screen 7) would be as shown by the dotted line 36 in FIG. 2, staying constant, slightly above one footcandle for light inputs from about 0.5 footcandle down to about $10^{-5}$ footcandle. While this one footcandle input light level is satisfactory for a human viewer, it is too high for an electronic scanner that reads the output screen 7 of the image intensifier. At light inputs from $10^{-5}$ footcandle down to about $10^{-8}$ foot-candle, the light output is a direct logarithmic function of the light input, decreasing in response to a decrease in the light input.

However, when the additional power supply is present it controls the screen voltage, as already explained, so that the light output of the image intensifier is as shown by the dash-dot line 37 in FIG. 2. In the useful light input range above about $5\times10^{-5}$ footcandle, the light output is substantially constant at less than one footcandle. (This is slightly lower than the corresponding part of curve 36 because the additional power supply is holding the screen voltage at about 5 kV, whereas it would be about 6 kv if only the internal power supply were present). At this level the output screen 7 of the image intensifier can be read accurately and safely by an electronic scanner. In the light input range below about $5\times10^{-5}$ footcandle, the light output remains at this constant level until the light input is below about $10^{-8}$ footcandle, at which point the light output drops to the ambient background light level. This extension of the substantially constant light output range to lower levels of light input is due to the increased screen voltage provided by the additional power supply in this light input range, as already described.

With this arrangement, the dynamic range of the system is extended by about one magnitude because of the increased screen voltage. This greatly increases the usefulness of the image intensifier in situations where its output screen is read by an electronically coupled scanner.

The heavier full line curve 38 in FIG. 2 shows the overall gain of the image intensifier tube having both the usual internal power supply 8 and the additional power supply in accordance with the present invention.

In the light input range from about 1 footcandle down to about $5\times10^{-5}$ footcandle, the gain is an inverse logarithmic function of the light input, going from a gain of about 200 at a one footcandle light input up to a gain of about 50,000 at a light input of about $5\times10^{-5}$ footcandle. The gain remains substantially constant at about 50,000 for light inputs from $5\times10^{-5}$ down to about $10^{-8}$ footcandle.

I claim:

1. In combination with an image intensifier having a photocathode, an anode and focusing cone, a microchannel plate, and an output screen, and having an internal power supply for producing a predetermined voltage on said output screen and supplying current to said output screen, an additional power supply operative to produce a voltage;

and impedance means coupling said additional power supply to said output screen to apply the voltage from said additional power supply to said output screen at a current which is a multiple on the order of 100 times the current from said internal power supply to said output screen, said impedance means having an A.C. impdendance on the order of 1 ohm in the frequency range from about 20,000 to 25,000 Hz. for filtering out power supply noise in that frequency range.

2. The combination of claim 1, wherein the current from said internal power supply to said output screen in on the order of microamperes, and the screen current produced by said additional power supply is on the order of hundreds of microamperes.

3. The combination of claim 2 wherein:

said additional power supply comprises voltage conversion means for producing a voltage on the order of thousands of volts for the output screen from a battery voltage on the order of 12 volts;

and said impendance means comprises a resistor connected in series between the output of said voltage conversion means and said output screen and having an impedance on the order of 33,333 ohms, and a capacitor connected between said output screen and ground and presenting an impedance on the order of 1 ohm in the 20,000–25,000 Hz. frequency range.

4. The combination of claim 1 wherein said additional power supply means comprises:

voltage conversion means for producing a voltage on the order of thousands of volts from a battery voltage on the order of 12 volts;

resistance means connected between the output of said voltage conversion means and said output screen, said resistance means having an impedance on the order of 33,333 ohms;

and a capacitor connencted between said output screen and ground and presenting an impedance on the order of 1 ohm in the 20,000–25,000 Hz. frequency range.

5. The combination of claim 1 and further comprising:

means operatively coupled to said additional power supply to maintain the voltage which it applies to the output screen lower than the screen voltage produced by said internal power supply throughout a predetermined range of the light input to the image intensifier.

6. The combination of claim 5 wherein said range is from substantially $5\times10^{-5}$ to 1 footcandle.

7. The combination of claim 6 and further comprising:

means for regulating the voltage which said additional power supply applies to the output screen as an inverse function of the light input to the image intensifier in the range below about $5\times10^{-5}$ footcandle;

said means for regulating being operative, at light inputs to to the image intensifier below about $10^{-5}$ footcandle, to maintain the screen voltage produced by said additional power supply higher than said predetermined screen voltage produced by said internal power supply.

8. The combination of claim 7 wherein said means for regulating comprises:

a reference terminal operatively connected to said internal power supply to present a voltage which is substantially proportional to the light input to the image intensifier;

an optical coupler including a light emitting diode operatively connected to said reference terminal to conduct current when the voltage at said reference terminal is below a value corresponding to a light input to the image intensifier less than about $5\times10^{-5}$ footcandle, and a phototransistor operatively arranged to receive light emitted by said light emitting diode and to conduct current substantially proportional to the light emitted by said light emitting diode;

and voltage control means operatively connected to said phototransistor and said additional power supply to increase the output voltage of said additional power supply with increasing current in the phototransistor.

9. The combination of claim 1 and further comprising:

means operatively coupled to said additional power supply for regulating the voltage which it applies to the output screen as an inverse function of the light input to the image intensifier in the range below about $5\times10^{-5}$ footcandle;

said means for regulating being operative, at light inputs to the image intensifier below about $10^{-5}$ footcandle, to maintain the screen voltage produced by said additional power supply higher than said predetermined screen voltage produced by said internal power supply.

10. The combination of claim 9 wherein said means for regulating comprises:

a reference terminal operatively connected to said internal power supply to present a voltage which is substantially proportional to the light input to the image intensifier;

an optical coupler including a light emitting diode operatively connected to said reference terminal to conduct current when the voltage at said reference terminal is below a value corresponding to a light input to the image intensifier less than about $5\times10^{-5}$ footcandle, and a phototransistor operatively arranged to receive light emitted by said light emitting diode and to conduct current substantially proportional to the light emitted by said light emitting diode;

and voltage control means operatively connected to said phototransistor and said additional power supply to increase the output voltage of said additional power supply with increasing current in the phototransistor.

11. The combination of claim 3 and further comprising means for regulating the voltage applied by said additional power supply means to the output screen of the image intensifier, said means for regulating comprising:

a reference terminal operatively connected to said internal power supply to present a voltage which is substantially proportional to the light input to the image intensifier;

an optical coupler including a light emitting diode operatively connected to said reference terminal to conduct current when the voltage at said reference terminal is below a value corresponding to a light input to the image intensifier less than about $5\times10^{-5}$ footcandle, and a phototransistor operatively arranged to receive light emitted by said light emitting diode and to conduct current substantially proportional to the light emitted by said light emitting diode;

and voltage control means operatively connected to said phototransistor and said additional power supply to increase the output voltage of said additonal power supply with increasing current in the phototransistor.

12. In combination with an image intensifier having a photocathode, an anode and focusing cone, a microchannel plate, and an output screen, and having an internal power supply for producing a predetermined voltage on said output screen and supplying current to said output screen, an additional power supply operative to produce a voltage;

and a filter coupling said additional power supply to the output screen of the image intensifier to apply a voltage from said additional power supply to the output screen at a current which is a multiple of the current provided by said internal power supply to said output screen, whereby said additional power supply establishes the voltage on said output screen irrespective of the voltage from said internal power supply, said filter having an A.C. impedance on the order of 1 ohm in the frequency range from about 20,000 to 25,000 Hz. for filtering out power supply noise in that frequency range.

13. The combination of claim 12 and further comprising means for regulating the voltage applied by said additional power supply means to the output screen of the image intensifier, said means for regulating comprising:

a reference terminal operatively connected to said internal power supply to present a voltage which is substantially proportional to the light input to the image intensifer;

an optical coupler including a light emitting diode operatively connected to said reference terminal to conduct current when the voltage at said reference terminal is below a value corresponding to a light input to the image intensifier less than about $5\times10^{-5}$ footcandle, and a phototransistor operatively arranged to receive light emitted by said light emitting diode and to conduct current substantially proportional to the light emitted by said light emitting diode;

and voltage control means operatively connected to said phototransistor and said additional power supply to increase the output voltage of said additonal power supply with increasing current in the phototransistor.

14. The combination of claim 13 wherein:

at light inputs to the image intensifier above about $5\times10^{-5}$ footcandle the voltage on said reference terminal maintains said light emitting diode in a non-conducting state, thereby keeping said phototransistor non-conductive;

and said voltage control maintains the screen voltage produced by said additional power supply below the screen voltage produced by said internal power supply as long as said phototransistor is non-conductive.

* * * * *